US010713894B2

(12) United States Patent
West

(10) Patent No.: US 10,713,894 B2
(45) Date of Patent: Jul. 14, 2020

(54) ROULETTE SIDE BET APPARATUS AND METHOD

(71) Applicant: Jonathan Charles West, La Jolla, CA (US)

(72) Inventor: Jonathan Charles West, La Jolla, CA (US)

( * ) Notice: Subject to any disclaimer, the term of this patent is extended or adjusted under 35 U.S.C. 154(b) by 66 days.

(21) Appl. No.: 15/894,376

(22) Filed: Feb. 12, 2018

(65) Prior Publication Data

US 2019/0251791 A1 Aug. 15, 2019

(51) Int. Cl.
*G07F 17/32* (2006.01)
*G07F 17/34* (2006.01)

(52) U.S. Cl.
CPC ..... *G07F 17/3258* (2013.01); *G07F 17/322* (2013.01); *G07F 17/323* (2013.01); *G07F 17/3267* (2013.01); *G07F 17/3272* (2013.01); *G07F 17/3288* (2013.01); *G07F 17/34* (2013.01)

(58) Field of Classification Search
CPC .. G07F 17/3258; G07F 17/322; G07F 17/323; G07F 17/3267; G07F 17/3272; G07F 17/3288; G07F 17/34
See application file for complete search history.

(56) References Cited

U.S. PATENT DOCUMENTS 3,732,559 A * 5/1973 Eichelberger ..... G09G 1/20 345/24
5,540,442 A 7/1996 Orselli et al.
5,718,431 A * 2/1998 Ornstein ..... A63F 3/00157 273/274
8,501,479 B2 8/2013 Smith et al.
8,562,412 B2 10/2013 Matsuno
2009/0227319 A1* 9/2009 Kido ..... G07F 17/3211 463/17
2010/0252997 A1* 10/2010 Walker ..... G07F 17/32 273/292
2011/0161076 A1* 6/2011 Davis ..... G06F 3/04842 704/231
2014/0094244 A1* 4/2014 Baron ..... G07F 17/323 463/17
2015/0087377 A1* 3/2015 Yee ..... G07F 17/3286 463/17
2016/0328905 A1 11/2016 Kohl et al.

* cited by examiner

*Primary Examiner* — Werner G Garner

(57) ABSTRACT

Disclosed is a side bet system for roulette game. The side bet system is easy for players to understand since it does not involve a random number generator and instead relies on the winning number from a round of play to determine if the side bet is won. The system utilizes a winning number database stack to select and display a plurality of predictions regarding the next winning number. Each prediction is associated with an icon and players wager on any or all of the icons. It allows a winning wager in a first round to ride for a second round of prediction by the icon and if the icon again predicts the winning number the wager pays off and rides for third round of prediction by the icon. If the icon correctly predicts the third consecutive number the wager pays off again and the series restarts.

5 Claims, 13 Drawing Sheets

SIDE BET RULES

- YOU CAN BET ON ANY OR ALL OF THE GIRLS
- BEFORE THE START OF EACH GAME, THE GIRLS WILL PREDICT THE WINNING NUMBER
- IF YOUR GIRL GETS IT RIGHT, YOU GET PAID 5/1
- YOUR BET RIDES ON TO THE NEXT GAME
- IF SHE GETS IT RIGHT AGAIN, YOU GET PAID 500/1 (OR PART OF A PROGRESSIVE JACKPOT)
- YOUR BET RIDES ON TO THE NEXT GAME
- IF SHE GETS IT RIGHT AGAIN, YOU GET PAID 5000/1 (OR A PROGRESSIVE JACKOUT)
- ANY TME A GIRL PREDICTS CORRECTLY, NO MORE BETS WILL BE ALLOWED ON HER

*FIG. 3*

FLOW DIAGRAM SHOWING WINNING SEQUENCE OF EVENTS WITH 3 ICONS

ROULETTE SIDE BET APPARATUS AND METHOD

CROSS-REFERENCE TO RELATED APPLICATIONS

NONE.

STATEMENT REGARDING FEDERALLY SPONSORED RESEARCH

NONE.

FIELD OF THE DISCLOSURE

This present disclosure relates generally to games of chance, and more particularly to a side bet apparatus and game to be used in conjunction with a roulette wheel game of chance.

BACKGROUND OF THE DISCLOSURE

This section provides background information which is not necessarily prior art to the inventive concepts associated with the present disclosure.

Roulette is a well-known game of chance enjoyed in casinos throughout the world. The basic equipment for a roulette wheel includes the wheel itself, a ball and a table with a gaming surface having wagering areas for placing bets on the outcome of a round of play. On an American roulette wheel there are 38 pockets each displaying a possible winning number in a round of play, the numbers are 1-36, 0 and 00. Each of the pockets for the numbers 1-36 has a color of either black or red, the 0 and 00 pockets are green. By way of contrast the French wheel used in most of Europe has 37 pockets each displaying a possible winning number in a round of play, the numbers are 1-36 and 0. The wagering areas in a typical American roulette wheel version include a layout with boxes for the numbers 1-36 arranged in three columns with 12 rows and at the end nearest the dealer above the numbers 1, 2 and 3 are boxes for 0 and 00. Each box for numbers 1-36 is surrounded by a border of black or red and the boxes for 0 and 00 have a green background, these 38 boxes represent the "inside bets" where you can bet on: a single number which pays 35 to 1; a split bet on two numbers which pays at 17 to 1; a row bet for three numbers which pays at 11 to 1; a corner bet for 4 numbers which pays at 8 to 1; a five number bet on the numbers 0, 00, 1, 2 and 3 which pays at 6 to 1; or a line bet on 6 numbers which pays at 5 to 1. Then outside the numbered boxes are a series of boxes with labels for other possible bets including: even which pays at 1 to 1; odd which pays at 1 to 1; red which pays at 1 to 1; black which pays at 1 to 1; 1 to 18 or low which pays at 1 to 1; 19 to 36 or high which pays at 1 to 1; dozens for 1-12 or 13-24 or 25-36 all of which pay at 2 to 1; one of the three columns all of which pay at 2 to 1. The payers place their wagers and the dealer then spins the wheel in one direction and tosses the ball onto a track in the wheel above the pockets in the opposite direction. When the ball is about ready to drop out of the track toward the pockets the dealer calls no more bets. The ball eventually comes to rest in one of the pockets and the dealer then collects all losing bets and then pays off all winning bets.

Because the casino edge on every bet is 5.26%, except for the 5 number bet where it is 7.89%, the game of roulette has lost popularity compared to other casino games with better odds for the players such as slot machines, craps, blackjack and poker. In addition, the maximal payout is 35 to 1 which is lower than that available in many other casino games. There have been attempts to introduce other betting options for roulette such as high reward fixed odds side bets or progressive jackpot-type bets, however, none of these have succeeded as of yet. One of the issues with attempts to expand the side betting on the roulette wheel is that there is limited space in a typical roulette wheel set up for the addition of side betting areas. The other issue is that the previous attempts required the side betting areas be pre-printed on the gaming table and thus the betting options could not be changed or altered. Many of the previous side bet concepts were also overly complex and thus required excessive instructions from the dealer to the players. Roulette is already a slow game in terms of the number of rounds per hour compared to other faster games such as slots, video poker, blackjack and craps therefore the side bet game to be successful must not slow the pace of play to any great extent. Many previous side bet concepts involved use of a random number generator to determine side bet winning outcomes and these random number generators are often distrusted by players. Finally, the maximal payout from many of these side bet concepts was 1000 to 1, which is not as high a payout as players desire.

Thus, it is desirable to create a side bet game to associate with a typical roulette wheel. It will be beneficial to create a game which is simple to understand and thus does not slow play at the roulette wheel. It is desirable to create a side bet game that does not dramatically increase the square footage required by the roulette wheel game itself. It is highly desirable to create a side bet game with much bigger payouts than found in typical side bet games and one that does not depend on a random number generator.

SUMMARY OF THE DISCLOSURE

This section provides a general summary of the present disclosure and is not intended to be interpreted as a comprehensive disclosure of its full scope or all features, aspects and objectives.

One aspect of the present disclosure is to provide a side bet system for a roulette game comprising: a winning number database stack comprising a plurality of positions equal to a total number of possible outcomes of a single round of play of a roulette game, a hierarchical arrangement of the possible outcomes in the positions within the stack with each of the possible outcomes arranged according to its historical frequency as a winning outcome, the most frequent winning outcome in a first position in the stack and the least frequent winning outcome in a last position of the stack; and a plurality of side bet icons, each icon being associated with a different possible outcome of a next round of play of the roulette game wherein each of the different possible outcomes is selected from the stack based on the position of the different possible outcome within the stack and on the previous winning outcome of a round of play.

In accordance with yet another aspect of the present disclosure, a method of a side bet system for a roulette game is disclosed comprising the steps of: a) providing a winning number database stack comprising a plurality of positions equal to the total number of possible outcomes of a single round of play of a roulette game; b) arranging all of the possible outcomes in the positions within the stack with each of the possible outcomes arranged according to its historical frequency as a winning outcome, with the most frequent winning outcome in a first position in the stack and the least frequent winning outcome in a last position of the stack; c)

providing a plurality of side bet icons, each icon being associated with a different possible outcome of a next round of play of the roulette game; d) selecting each of the different possible outcomes of each of the icons from the stack based on the position of the different possible outcome within the stack and on the previous winning outcome of a round of play with the previous winning outcome determining the position in the stack from which the first different possible outcome is selected and with all additional different outcomes selected from the subsequent next position down in the stack until a different possible outcome has been selected for each icon; e) displaying each selected different possible outcome in association with its icon; f) allowing a player to place a wager on each different possible outcome associated with each icon; g) playing a round of roulette to determine a first consecutive winning number, if any wager was placed on an icon displaying the first consecutive winning number then the first consecutive winning wager is paid off at a first amount and this first consecutive winning wager is allowed to ride through a second consecutive round of play to determine the second consecutive winning number, the dealer collecting all losing wagers and if no winning wagers were placed then steps b) to g) are repeated until a first consecutive winning wager is achieved, then play proceeds to step h); h) once a first consecutive winning wager is achieved steps b) to f) are repeated with the exception that in step f) no additional wager is allowed on the icon that had a first consecutive winning wager in the previous round of play, then a second consecutive round of play is conducted to determine the second consecutive winning number, if in the second consecutive round of play the icon which had the first consecutive winning wager also displays the second consecutive winning number then the second consecutive winning wager is paid off at a second amount greater than the first amount and the wager is again allowed to ride for a third consecutive round of play as described in step i), if on the other hand a different icon displays the second consecutive winning number then the wager is paid off as described in step g) as a first consecutive winning wager and step h) is repeated with the wager on this different icon riding for the second consecutive round of play, all losing wagers are collected by the dealer and if no icon displays the second consecutive winning number then play reverts to steps b) to g) until a first consecutive winning wager is again achieved; i) if on the second consecutive round of play a second consecutive winning wager is achieved steps b) to f) are repeated again with the exception that in step f) no additional wager is allowed on the icon that had the first consecutive winning wager in the first round of play and the second consecutive winning wager in the second consecutive round of play, then a third consecutive round of play is conducted to determine the third consecutive winning number, if in the third consecutive round of play the icon which had the first and second consecutive winning wagers also displays the third consecutive winning number then the wager is paid off at a third amount greater than the second amount and the wager is returned to the player and play reverts to steps b) to g), optionally, the third consecutive winning wager on the third consecutive round of play can be allowed to continue to ride for additional successive rounds of play with an increasing payout for each correct successive prediction until the prediction is not correct then the wager is returned to the player and play reverts to steps b) to g), if on the other hand a different icon displays the third consecutive winning number then the wager is paid off as described in step g) as a first consecutive winning wager and step h) is repeated with the wager on this different icon riding for the second consecutive round of play, all losing wagers are collected by the dealer, and if no icon displayed the third consecutive winning number then play reverts to steps b) to g) until a first consecutive winning wager is again achieved.

These and other features and advantages of this disclosure will become more apparent to those skilled in the art from the detailed description herein. The drawings that accompany the detailed description are described below.

BRIEF DESCRIPTION OF THE DRAWINGS

The drawings described herein are for illustrative purposes only of selected aspects and not all implementations, and are not intended to limit the present disclosure to only that actually shown. With this in mind, various features and advantages of example aspects of the present disclosure will become apparent to one possessing ordinary skill in the art from the following written description and appended claims when considered in combination with the appended drawings, in which:

FIG. 3 shows the side bet rules that would be presented on a display before each round of play according to the present disclosure;

DETAILED DESCRIPTION OF THE DISCLOSURE

Figure 1:
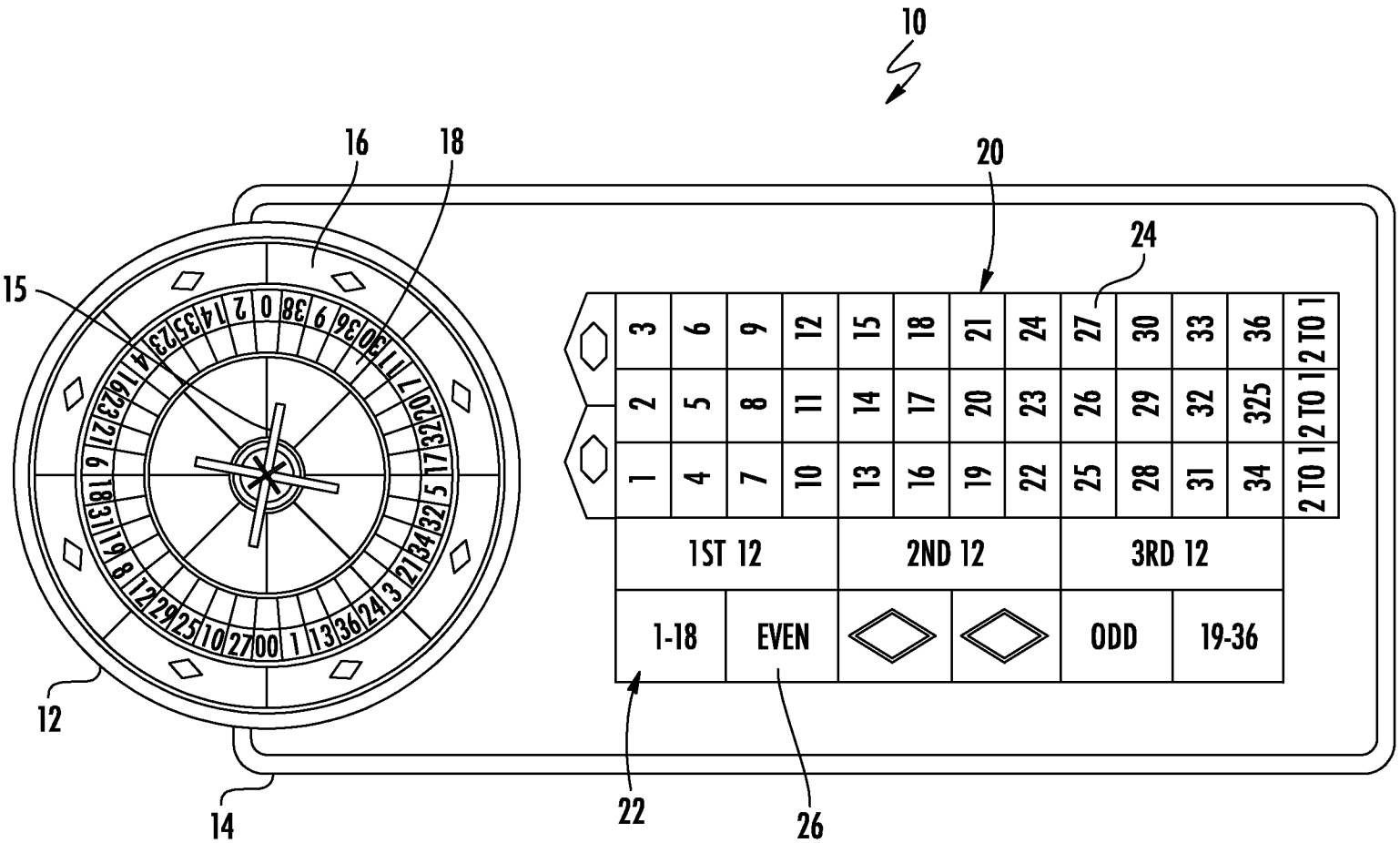
FIG. 1 shows a top view of a typical American style roulette wheel and game table.

In the following description, details are set forth to provide an understanding of the present disclosure.

For clarity purposes, example aspects are discussed herein to convey the scope of the disclosure to those skilled in the relevant art. Numerous specific details are set forth such as examples of specific components, devices, and methods, in order to provide a thorough understanding of various aspects of the present disclosure. It will be apparent to those skilled in the art that specific details need not be discussed herein, such as well-known processes, well-known device structures, and well-known technologies, as they are already well understood by those skilled in the art, and that example embodiments may be embodied in many different forms and that neither should be construed to limit the scope of the disclosure.

The terminology used herein is for the purpose of describing particular example aspects only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or feature is referred to as being "on," "engaged to," "connected to," "coupled to" "operably connected to" or "in operable communication with" another element or feature, it may be directly on, engaged, connected or coupled to the other element or layer, or intervening elements or features may be present. In contrast, when an element is referred to as being "directly on," "directly engaged to," "directly connected to," or "directly coupled to" another element or feature, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly and expressly indicated by the context. Thus, a first element, component, region, layer or section discussed below could be termed a second element, component, region, layer or section without departing from the teachings of the example embodiments.

For purposes of description herein, the terms "upper," "lower," "right," "left," "rear," "front," "vertical," "horizontal," and derivatives thereof shall relate to the invention as oriented in the FIGS. However, it is to be understood that the present disclosure may assume various alternative orientations and step sequences, except where expressly specified to the contrary. It is also to be understood that the specific devices and processes illustrated in the attached drawings, and described in the following specification are exemplary aspects of the inventive concepts defined in the appended claims. Hence, specific dimensions and other physical characteristics relating to the aspects disclosed herein are not to be considered as limiting, unless the claims expressly state otherwise.

FIG. 1 shows a top view of an American roulette wheel system generally at 10. The system 10 includes a roulette wheel 12 supported on a table top 14 having wagering areas on it. The wheel 12 includes a handle 15 to aid a dealer in spinning the wheel 12, a track 16 and a series of 38 numbers, 1-36 and 0 and 00, each number associated with a pocket 18. Each of the pockets 18 for the numbers 1-36 has a color of either black or red, the 0 and 00 pockets are green. The wagering area in a typical American roulette wheel system 10 includes a layout with an "inside bets" area 20 and an "outside bets" area 22. The "inside bets" area 20 has a series of boxes 24 for wagering bets on outcomes of a round of play. In the "inside bets" area 20 the numbers 1-36 are arranged in the boxes 24 in three columns with 12 rows and at the end nearest the dealer and above the numbers 1, 2 and 3 are boxes 24 for 0 and 00. Each box 24 for numbers 1-36 is surrounded by a border of black or red to correspond with the number's color on the wheel 12 and the boxes 24 for 0 and 00 are green. These boxes 24 represent the "inside bets" area 20 where you can bet by placing a bet on: a single number which pays 35 to 1; the line between two boxes 24 which is a split bet on the two numbers and pays at 17 to 1; a line for a row to bet a row for three numbers which pays at 11 to 1; a corner which bets on 4 numbers pays at 8 to 1; the line between the boxes 24 for 0 and 1 which places a five number bet on the numbers 0, 00, 1, 2 and 3, which pays at 6 to 1; or a line between two rows which bets on 6 numbers and pays at 5 to 1. Then outside the numbered boxes 24 are another series of boxes 26 with labels for the possible "outside bets" area 22 including: the even box 26 which pays at 1 to 1; the odd box pays at 1 to 1; the red box pays at 1 to 1; the black box pays at 1 to 1; 1 to 18 or low box pays at 1 to 1; 19 to 36 or high box pays at 1 to 1; dozens boxes for 1-12 or 13-24 or 25-36 all pay at 2 to 1; and finally one of the three column boxes pay at 2 to 1. The players place their wagers on whichever boxes 24 or lines they wish in the "inside bets" area 20 or in the boxes 26 in the "outside bets" area 22 and the dealer then spins the wheel 12 in one direction by rotating the handle 15 and then tosses a ball, not shown, onto the track 16 in the wheel 12 in the opposite direction. When the ball is about ready to drop out of the track 16 toward the pockets 18 the dealer calls "no more bets" or waves his hand over the wagering area to signal no more bets. The ball eventually comes to rest in one of the pockets 18 and the dealer collects all losing bets and then pays off all winning bets based on the pocket 18 the ball rests in. To keep the bets separated each player receives chips of a different color and the value of each chip is designated before play begins. The roulette chips are not used anywhere else in the casino and they have no value away from the roulette table. When a player wishes to leave the roulette table the chips are exchanged for regular casino chips based on their previously decided value.

Figure 2:
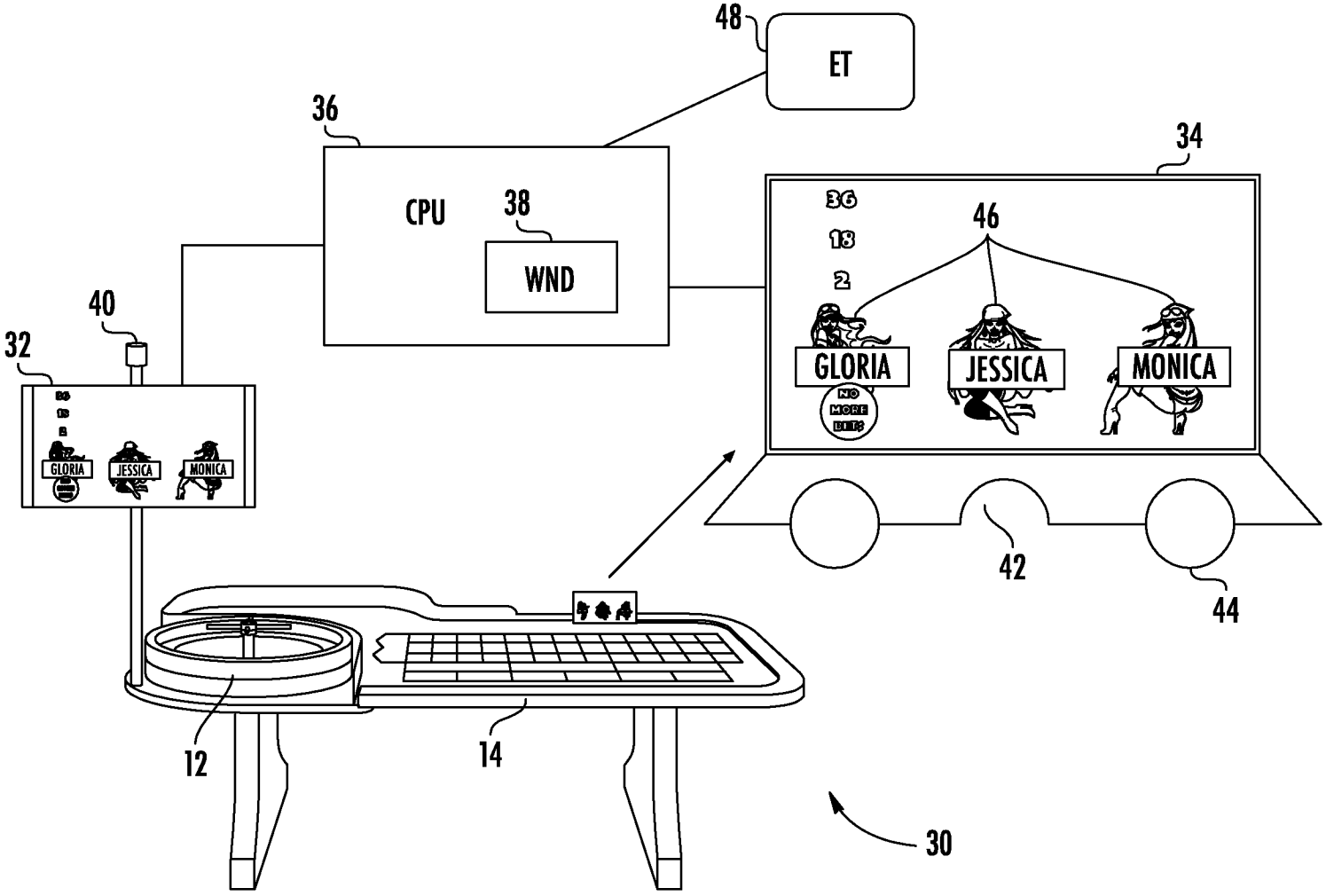
FIG. 2 shows a side view of a roulette wheel system in accordance with the present disclosure.

FIG. 2 shows a side view of a roulette wheel with a side bet system 30 in accordance with the present disclosure. It includes all the features described for the system 10 shown in FIG. 1 plus addition features as described herein. The system 30 includes the wheel 12 and the table top 14 with the wagering area for the "inside bets" area 20 and the "outside bets" area 22 as described above. The system 30 includes a main display 32, a side bet display 34, which is shown enlarged in FIG. 2, a computer processing unit (CPU) 36 having a Winning Number Database stack (WND) 38 and a camera 40. The side bet display 34 includes a plurality of chip racks 42 for accepting wagering chips 44 with each rack 42 associated with a side bet icon 46 shown on the display 34. Although not shown the identity and number of chips in a given rack 42 are detected by sensors, such as optical sensors, connected to and in communication with the CPU 36 and so each wager amount and the identity of the chips in a rack 42 can be tallied and recorded by the CPU 36 for communication to the dealer. The system 30 can also include electronic terminals 48 connected to the CPU 36 to allow for remote or stadium style play. The electronic terminals 48 simulate all of the wagering areas on the table top 14 and the side bet display 34 and allow players to place any available bets. The CPU 36 is also in communication with the camera 40 and the displays 32 and 34. The camera 40 detects the location of the ball during a round of play and communicates its position to the CPU 36. The system 30 operates in the same manner as a typical roulette wheel 10 plus includes the enhanced side bet option according to the present disclosure which is described below. If desired the roulette wheel system 30 can be an electronic table game as is known in the art connected to a series of electronic terminals 48 through the CPU 36.

The side bet system and method will be explained for a system 30 using three icons 46 for simplicity's sake, however, as will be know to one of skill in the art the number of icons 46 could be more than three. The CPU 36 includes a Winning Number Database stack (WND) 38 as noted. This WND stack 38 has thirty-eight (38) positions, one for each pocket 18 on the wheel 12. The WND stack 38 arranges the numbers from the wheel 12 in a historical, hierarchical position based on their historical frequency as the winning number for the roulette wheel 12. Thus position 1 in the WND stack 38 is occupied by the number with current highest frequency of being a winning number, position 2 in the WND stack 38 is the second most frequent winning number and so on with position 38 in the WND stack 38 being the least frequent winning number. After each round of play the position of the wheel numbers in the WND stack 38 is rearranged, as required, to reflect the new winning frequency distribution of each of the numbers from the wheel 12. The time period of the historical winning numbers can be adjusted to use any time period of play. For example the WND stack 38 historical record could be reset to time 0 every 24 hours, every 7 days, every month, every year, or never re-set as desired by an operator.

Table 1 shows an example of the WND stack 38 at a point in time using a standard United States roulette wheel, the WND stack 38 for a French style wheel would be the same except the wheel number 00 is not used on that style of roulette wheel and thus the WND stack 38 would have one fewer positions and 00 would not appear in the WND stack 38. The WND stack 38 shown in Table 1 represents the arrangement at a given point in time. After the next round of play the wheel numbers would be rearranged in the WND stack 38 to reflect the new historical hierarchical ordering based on the most recent winning number. The sum total of the winning percentages will always equal 100%. So for example if the next winning number were to be wheel number 33 it might move up in the WND stack 38 to be in position 7 while wheel number 22 might move down to position 8 and other wheel numbers might also move position within the WND stack 38.

TABLE 1

| WND stack POSITION | CURRENT WINNING % | WHEEL NUMBER |
|---|---|---|
| 1 | 3.289 | 0 |
| 2 | 3.263 | 27 |
| 3 | 3.237 | 29 |
| 4 | 3.211 | 31 |
| 5 | 3.184 | 12 |
| 6 | 3.158 | 26 |
| 7 | 3.132 | 22 |
| 8 | 3.131 | 33 |
| 9 | 3.080 | 3 |
| 10 | 3.053 | 15 |
| 11 | 3.026 | 2 |
| 12 | 3.000 | 25 |
| 13 | 2.947 | 00 |
| 14 | 2.921 | 17 |
| 15 | 2.895 | 23 |
| 16 | 2.868 | 36 |
| 17 | 2.842 | 1 |
| 18 | 2.816 | 11 |
| 19 | 2.763 | 6 |
| 20 | 2.711 | 5 |
| 21 | 2.658 | 21 |
| 22 | 2.605 | 10 |
| 23 | 2.526 | 32 |
| 24 | 2.474 | 16 |
| 25 | 2.447 | 13 |
| 26 | 2.421 | 7 |
| 27 | 2.395 | 19 |
| 28 | 2.368 | 20 |
| 29 | 2.316 | 24 |
| 30 | 2.237 | 35 |
| 31 | 2.053 | 30 |
| 32 | 2.026 | 28 |
| 33 | 1.921 | 14 |
| 34 | 1.895 | 9 |
| 35 | 1.868 | 8 |
| 36 | 1.842 | 18 |
| 37 | 1.737 | 34 |
| 38 | 1.684 | 4 |

FIG. 3 shows an example of the side bet rules that would be presented on one or both of the displays 32 and 34 before each round of play according to the present disclosure. These rules explain the basics of the side bet method according to the present disclosure. The word "girls" in the side bet rules could be replaced by any icon 46 designation desired by a game manufacturer, for example, the icons 46 could be guys, animals, mystical creatures, plants, or any other image. As shown in FIG. 3 the basic side bet rules are few and simple to understand. At the start of a new sequence a player can bet on any one or all of the girls 46. At the start of a sequence the player is betting that the girl 46 will correctly predict the next winning number. Before the start of each game each girl 46 will display her predicted number 52 and bets can be placed in the correct rack 42 or on the electronic terminal 48 for any icon 46, except as explained herein. If your girl 46 correctly predicts the winning number then your bet rides to the next round of play and you have won the first round of consecutive play, you are paid off at the casino's fixed odds for this round, for example 5 to 1, and your bet rides the next round. The payout could also be a portion of a progressive jackpot as described herein and as known in the art. The fixed odds could also be any odds the casino decides, 5 to 1 was just picked as an example. Once a girl 46 correctly predicts a winning number 52 no further bets can be placed on her 46 until after she 46 either correctly predicts the next two winning numbers consecutively or fails to predict a winning number on the next round of play. All bets placed on girls 46 who do not correctly predict a winning number are losers and are cleared before the next round of play. The goal is to pick an icon 46, girl, who correctly predicts three or more consecutive winning numbers. Before the start of each game each girl 46 predicts her winning number, no girl 46 will predict the same number, and the predicted number 52 is displayed above the girl 46 in a thought bubble 50 as shown in FIGS. 5 to 12. Players can continue to bet on one or more girls 46, unless the girl 46 correctly predicted the previous winning number as explained herein, until the call for "No more bets" by the dealer, thus the players see what number 52 each girl 46 has predicted before they place their bets and the predicted number 52 is always one of the numbers on the wheel 12. Therefore, it is easy for players to understand the predicted number 52 of each girl 46 unlike previous side bet systems utilizing a random number generator. The predicted number 46 is never a random number instead it is one of the numbers from the wheel that is selected based on the WND stack 38 position as explained herein.

Figure 4:
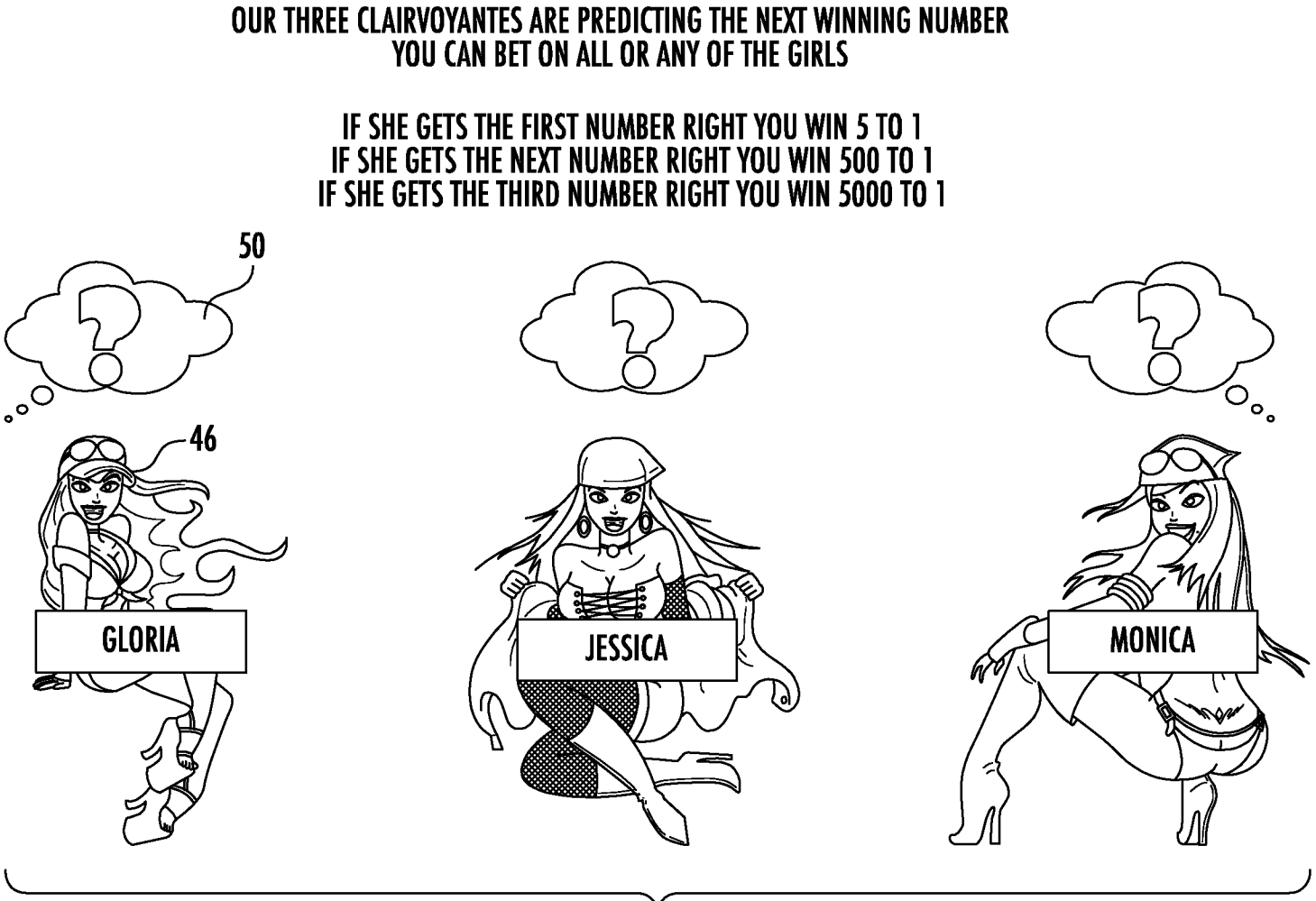
FIG. 4 shows an example of a side bet display that would appear using three icons and represents a point in time before the icons have displayed their predictions for the next winning number in accordance with the present disclosure.
Figure 5:
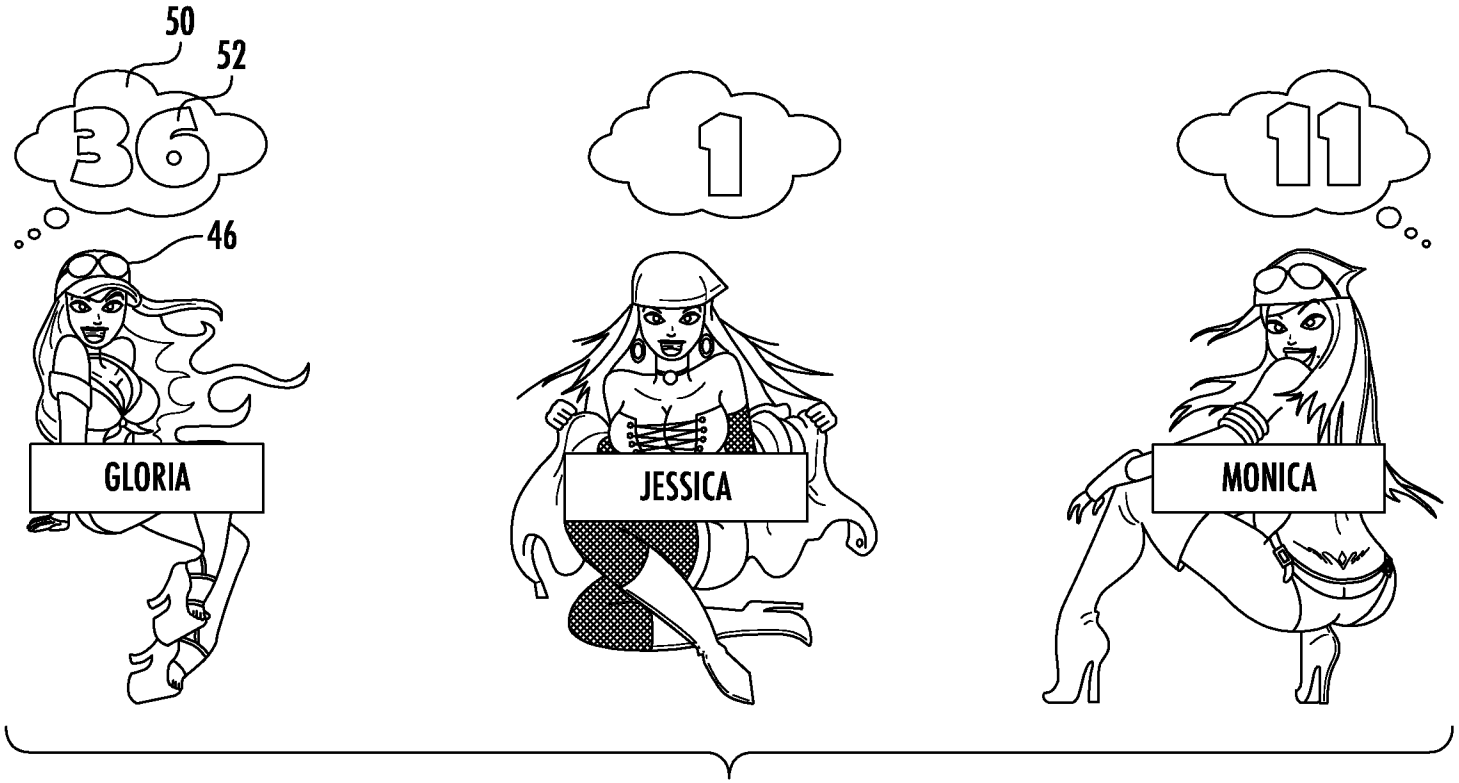
FIG. 5 shows an example of the side bet display that would appear using the three icons from FIG. 4 and represents a point in time after the icons have displayed their predictions for the first winning number in a three round sequence of play in accordance with the present disclosure.

FIG. 4 shows an example of the display that is shown prior to display of the predicted number 52 by each girl 46, if desired the display can again show the basic side bet rules as seen in FIG. 4. This display is shown on one or both displays 32, 34. FIG. 5 shows the three girls 46 of FIG. 4 each displaying in their thought bubble 50 their next predicted winning number 52. The predicted winning numbers 52 appear in each thought bubble 50 once the camera 40 signals the CPU 36 that the dealer has tossed the ball into the track 16. The number each icon 46 predicts in each round is taken from the WND stack 38 as follows: the CPU 36 queries the WND stack 38 position number that is equal to the previous winning number and assigns to a first icon 46 the number currently associated with that position then continues down the WND stack 38 in sequence for the rest of the icons 46. If the winning number is 0 or 00 then the WND stack 38 positions are positions 37 and 38 respectively. So for example, if the previous winning number was 10, then the next predicted number for the first icon 46 would be the number that is now associated with position 10 in the WND stack 38, the next predicted number for the second icon 46 would be the number currently in position 11 in the WND stack 38 and so on for all of the icons 46. In the next round of play the position of the icons 46 changes meaning the previous "second" icon is now the "first" icon and so on in round robin fashion to ensure that the order of assignment of numbers from the WND stack 38 shows no preference. When the winning number is 0 or 00 then the selection from the WND stack 38 proceeds as follows: the number associated with position 37 or 38 is assigned to the current "first" icon 46, then the number at position 1 or 38 goes to the "second" icon 46 and so on until all icons 46 have been assigned a number from the WND stack 38. So as can be seen in FIG. 5 the girls 46 have each predicted a winning number 52 for the current round of play and the players can bet on one or more girls 46 until the dealer calls "No More Bets". The bets are placed in the side bet racks 42 or on the electronic terminal 48. As noted herein the side bet display 34 includes one or more sensors, not shown, that can detect the identity and denomination of the chips 44 bet in each rack 42.

Figure 6:
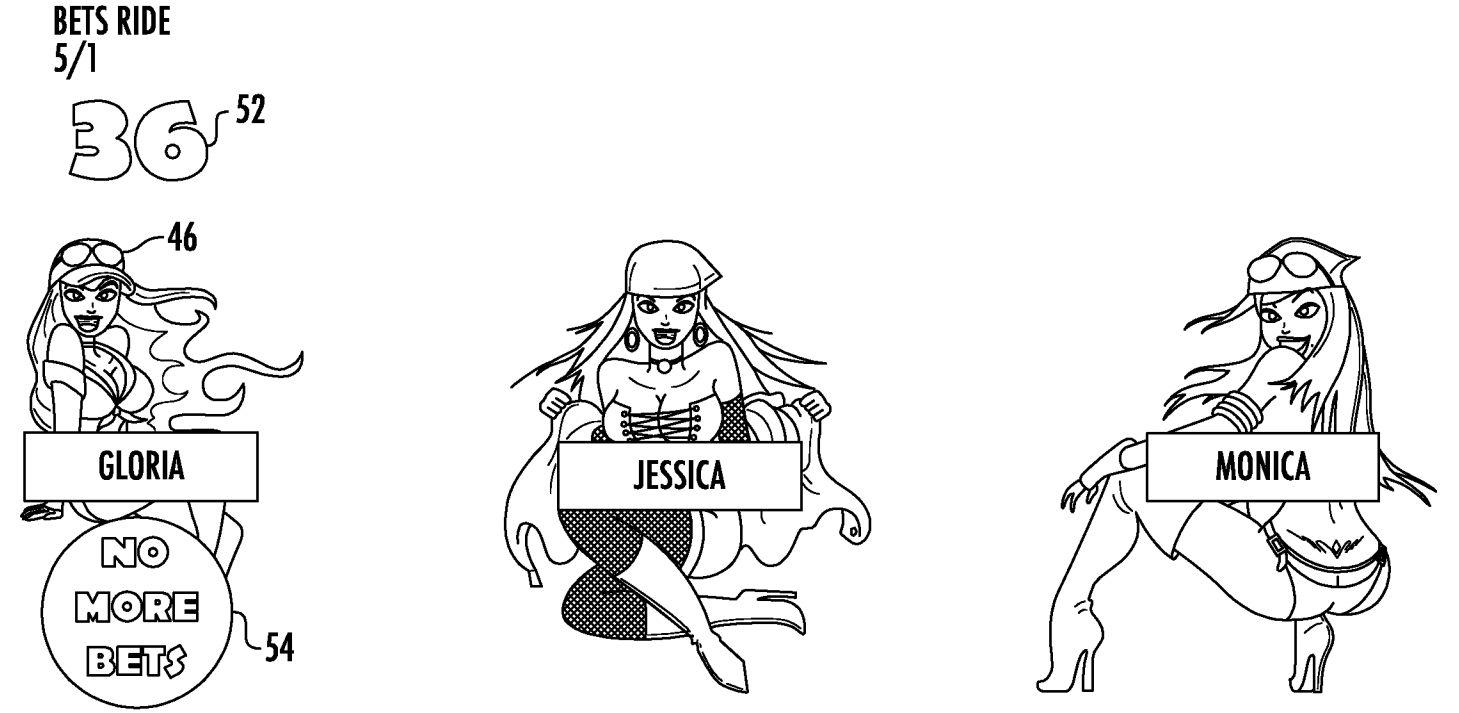
FIG. 6 shows an example of the side bet display of FIG. 5 after the "GLORIA" icon has correctly predicted the first winning number in the three round sequence of play according to the present disclosure.
Figure 7:
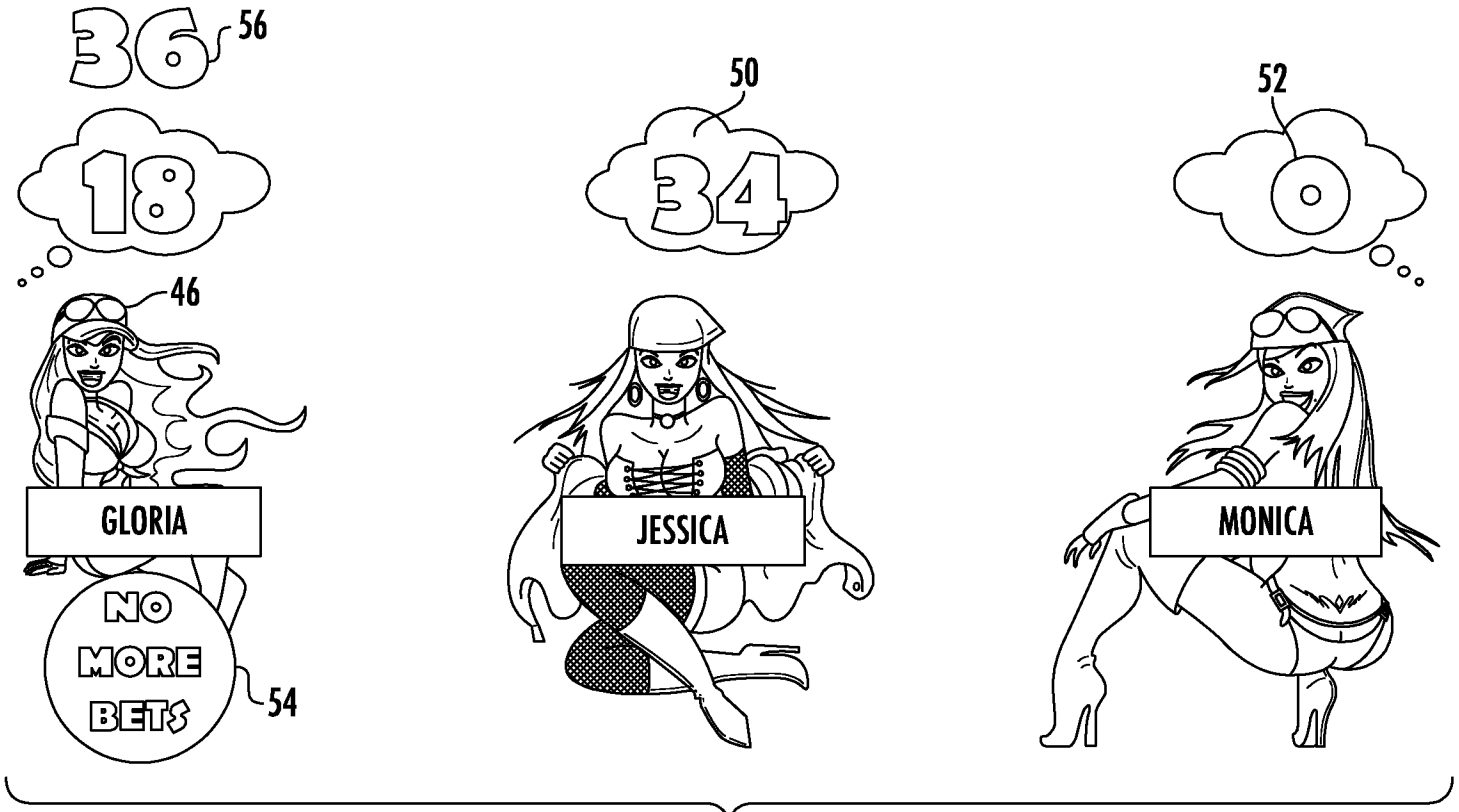
FIG. 7 shows an example of the side bet display of FIG. 6 after the icons have predicted the second winning number in a three round sequence of play according to the present disclosure with the "GLORIA" icon having correctly predicted the first winning number.

If a girl 46 correctly predicts the first winning number in a sequence, see FIG. 6, then below that girl 46 the sign "No More Bets" 54 appears so no more bets are allowed on a girl 46 once she has correctly predicted a winning number until she either correctly predicts the next two consecutive winning numbers or fails to predict the next winning number, any bets placed on the girl 46 who correctly predicts the first winning number in a sequence ride for the next round of play after a correct prediction. The "No More Bets" 54 appears next to an icon 46 who correctly predicts a winning number even if no bets were placed on the icon 46 until the icon 46 either correctly predicts three consecutive winning numbers or fails to predict the next winning number in a sequence. As shown in FIG. 6 "GLORIA" 46 correctly predicted the first winning number would be 36 therefore the bets placed on her 46 ride to the next round and are payed off at 5 to 1, for example, and no more bets are allowed on her. Also above the winning prediction the display 32, 34 flashes "BETS RIDE" to indicate that the previously placed bets ride through the next prediction. All bets placed on the other two girls 46 "JESSICA" and "MONICA" were losers and are cleared. In the next round of play bets can be placed on the girls 46 "JESSICA" or "MONICA", but not "GLORIA". Above "GLORIA" the first correct prediction 56 continues to be displayed as shown.

In the next round of play, continuing in this example, the numbers that appear as the girls 46 predictions will come from positions 36, 37 and 38 of the WND stack 38 because the last winning number was 36. As discussed, each round of play results in the WND stack 38 rearranging the position of each number as required based on its historical frequency as the winning number. See FIG. 7, the display, 32 and/or 34, shows the previous winning prediction 56 from the previous round of play, the number 36, and the new predictions for the current round of play by each icon 46. As noted no additional bets can be placed on "GLORIA" and the previously placed bets on her are riding in the current round. New bets can be placed on "JESSICA" or "MONICA" in the current round of play. Again the predicted numbers 52 appear in the thought bubbles 50 once the camera 40 signals the CPU 36 that the ball has been released into the track 16 and the predicted numbers 52 are assigned to each icon 46 from the WND stack 38 as described herein.

Figure 8:
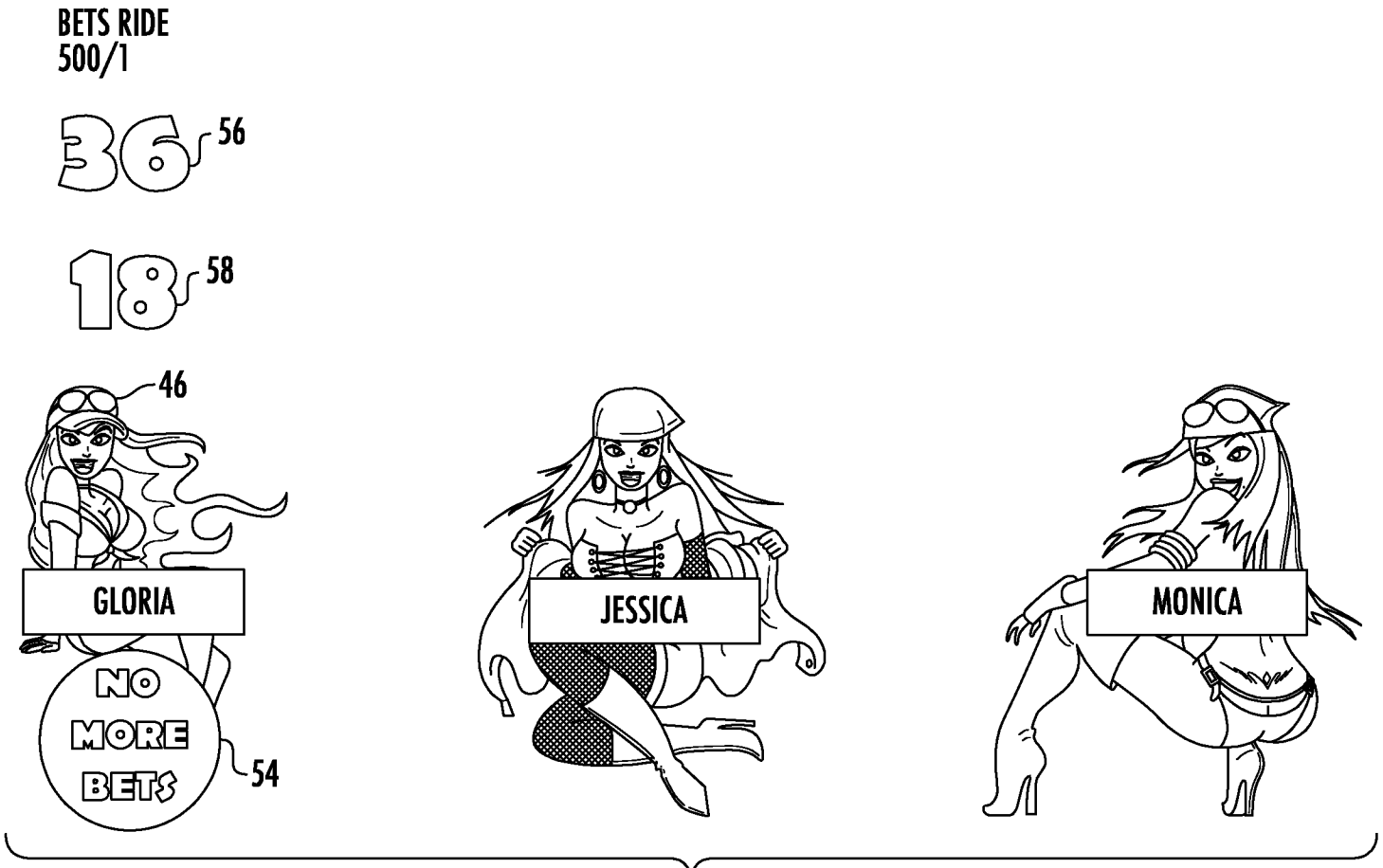
FIG. 8 shows an example of the side bet display of FIG. 7 after the "GLORIA" icon has correctly predicted the first and the second consecutive winning numbers in a three round sequence of play according to the present disclosure.
Figure 9:
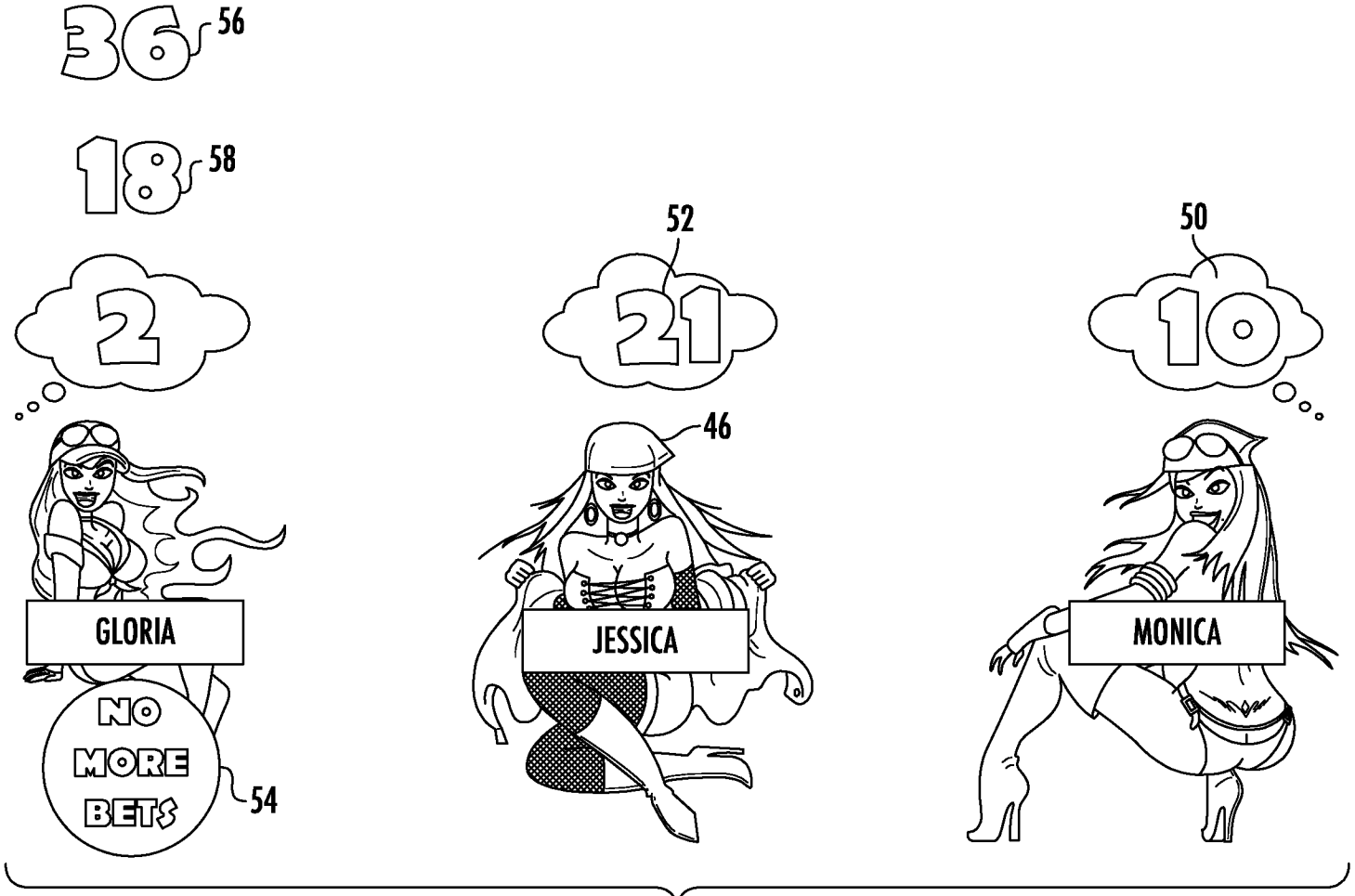
FIG. 9 shows an example of the side bet display of FIG. 8 after the icons have predicted the third winning number in a three round sequence of play according to the present disclosure with the "GLORIA" icon having correctly predicted the first and second consecutive winning numbers.

FIG. 8 shows that "GLORIA" has again correctly predicted the winning number, 18 in this example. So she has correctly predicted two consecutive winning numbers and the original bets continue to ride and now are paid off at 500 to 1, for example, or as explained above any odds set by the casino or a portion of a progressive jackpot. The bets placed on "JESSICA" and "MONICA" were again losers. The display, 32 and/or 34, now shows the first correct prediction 56 the number 36 and the second correct prediction 58 the number 18 and the notation "BETS RIDE 500/1".

In round three, shown in FIG. 9, the icons 46 again display their winning number predictions 52 and "GLORIA" shows her correct first 56 and second predictions 58. The predictions 52 in this round, because the last winning number was 18, come from positions 18 to 20 in the WND stack 38. Again the previous bets placed on "GLORIA" ride for a second time and new bets can be placed on "JESSICA" and "MONICA" only.

Figure 10:
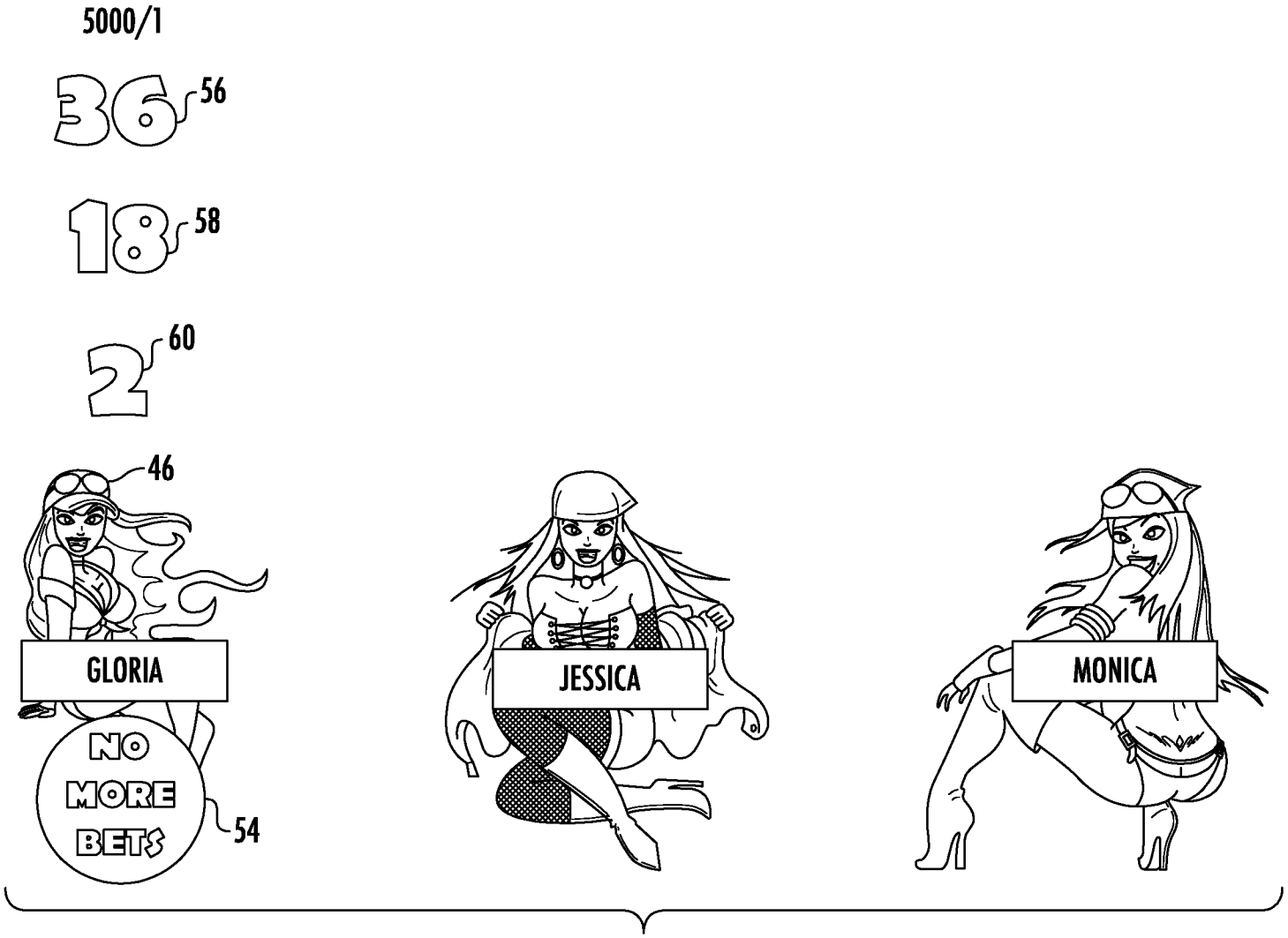
FIG. 10 shows an example of the side bet display of FIG. 9 after the "GLORIA" icon has correctly predicted the first, second and third consecutive winning numbers in a three round sequence of play according to the present disclosure.
Figure 11:
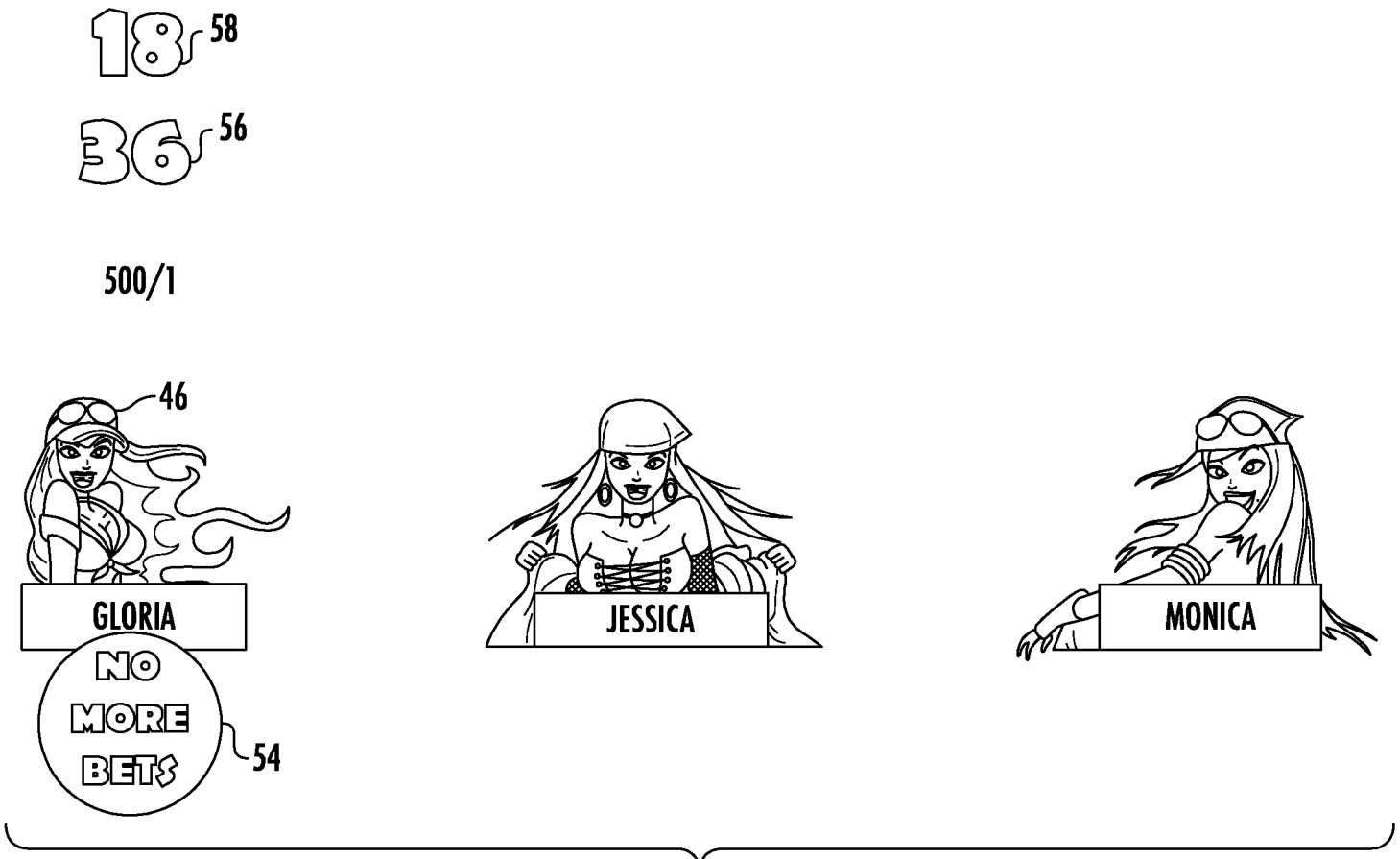
FIG. 11 shows an example of the side bet display of FIG. 9 after the "GLORIA" icon has correctly predicted only the first and second consecutive winning numbers but not the third consecutive winning number in a three round sequence of play according to the present disclosure.

As shown in FIG. 10 "GLORIA" has correctly predicted the last three consecutive winning numbers with the third one 60 being the number 2, the second one 58 being the number 16 and the first one 56 being 36. Above "GLORIA" the sign 5000/1, for example, flashes to indicate the payoff for this round. So a player who bet on "GLORIA" in the first round wins, for example, payouts of 5 to 1, 500 to 1 and 5000 to 1. Now "GLORIA"'s sequence is over and bets can again be placed on her in the next round. If in the above example "GLORIA" had only correctly predicted two consecutive winning numbers, as shown in FIG. 11, then after the third round the players who bet on her would have been paid out at 5 to 1 and 500 to 1 and her sequence would have ended. In the example of FIG. 11 the number 2 predicted in the third round was not correct so "GLORIA" only pays out at 5 to 1 and 500 to 1. As shown in FIG. 11 the order of correct predictions, 56 and 58, can be in any desired consistent order. Likewise if "GLORIA" had only predicted 1 correct number her sequence would have ended in the second round and she would pay out a 5 to 1. The payout odds could be different from these as determined by the casino. The actual odds are of the consecutive guesses being correct are 38 to 1 for the first one, 1444 to 1 for the second one being correct and 54872 to 1 for the third one being correct. Thus, with a payout of 5 to 1 the house edge is 86.84%, a payout of 500 to 1 has a house edge of 65.37% and a payout of 5000 to 1 has a house edge of 90.89%. The payout odds could be any sequence decided by the house such as 10 to 1, 1000 to 1 and 10,000 to 1 if desired or any portions of a progressive jackpot. In the example sequence above the wager was allowed to ride for three consecutive winning numbers; however to add even more excitement the wager could be allowed to ride for four consecutive winning numbers or be allowed to ride until the sequence of correct consecutive winning predictions ends. So for example, there could be even higher payouts of 1,000,000 to 1 for a fourth consecutive correct prediction, the actual odds being 2,085,136 to 1. This could continue for as many consecutive payouts as a casino desires. The excitement that this could generate would be tremendous and makes the side bet system very attractive for casinos and for players. Therefore, in another embodiment, the wager is allowed to ride for each correctly predicted consecutive winning number with increasing amounts of payout for each successive correct prediction. The sequence and payouts continue until the icon fails to correctly predict the next consecutive winning number. Each successive correct prediction paying out at higher odds or a higher amount of a progressive jackpot.

Figure 12:
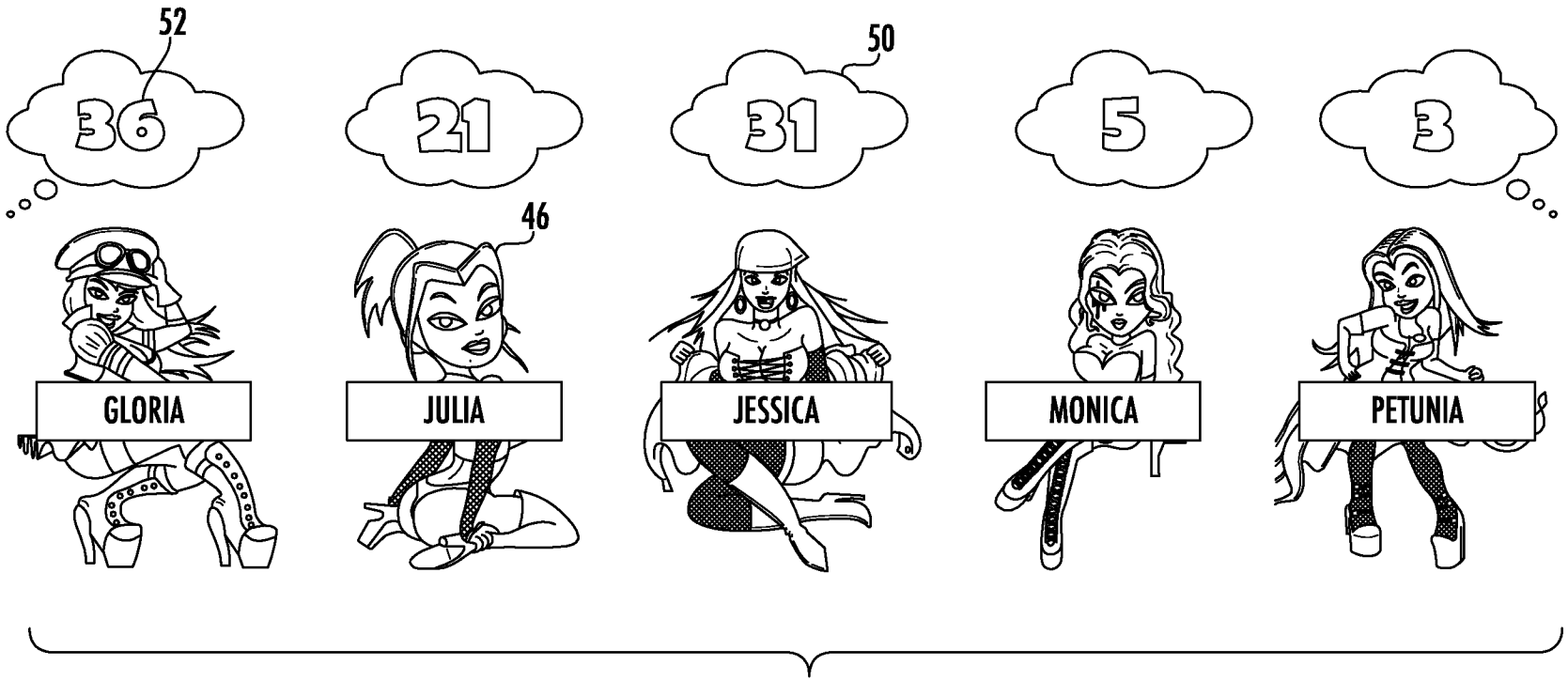
FIG. 12 shows an example of the side bet display like that shown in FIG. 4 that would appear using 5 icons and represents a point in time after the icons have displayed their predictions for the first winning number in a three round sequence of play in accordance with the present disclosure.
Figure 13:
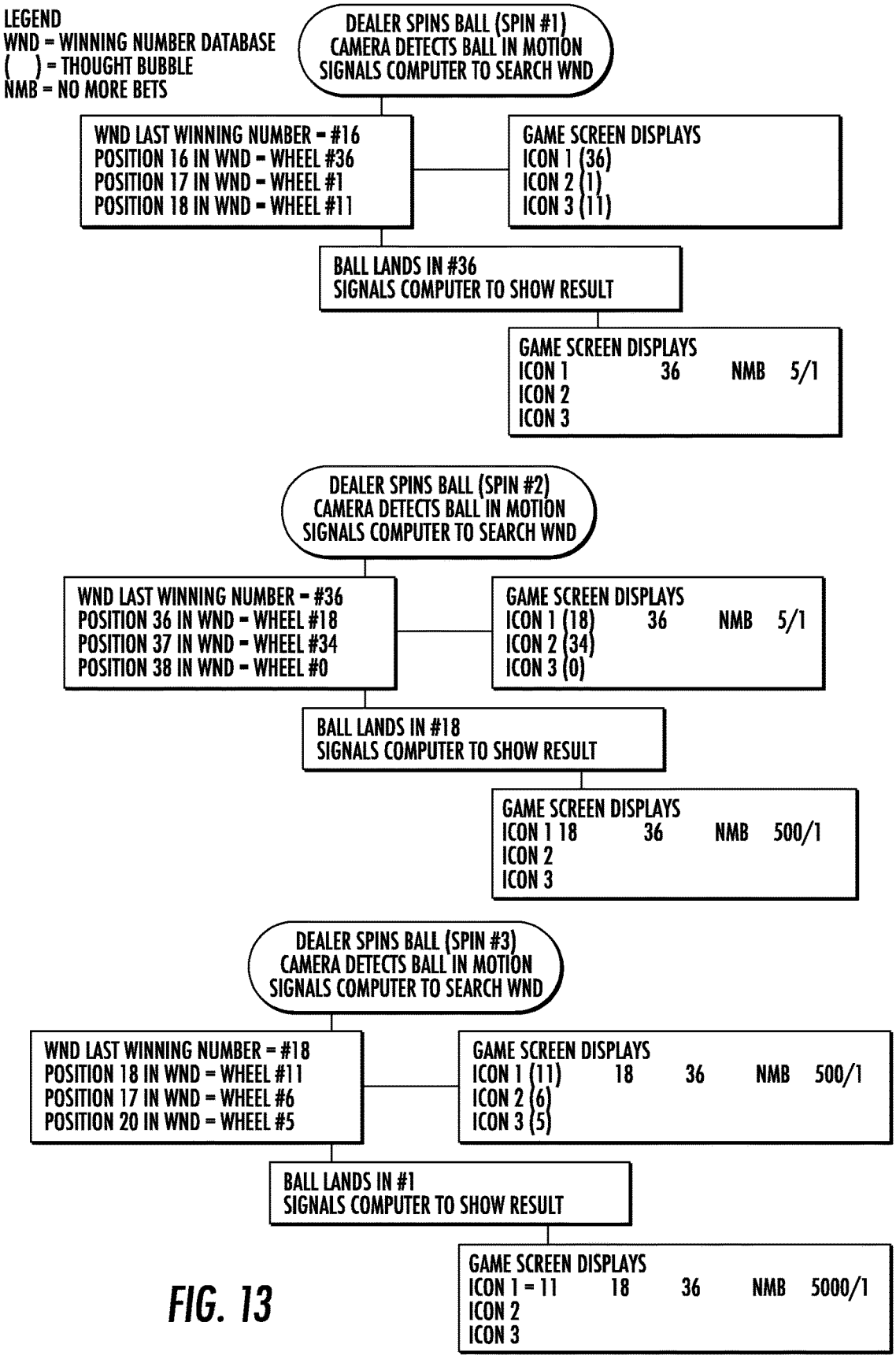
FIG. 13 shows a flow diagram of a three round sequence of play with the side bet system according to the present disclosure.

As shown in FIG. 12, there can be more than three icons 46 displayed on the displays 32 and/or 34. Each round each icon 46 predicts its own number selected from the WND stack 38 in the manner described herein based on the previous winning number. FIG. 13 shows a flow diagram of the sequence for three icons 46 wherein the first icon 46 correctly predicts three consecutive winning numbers as explained herein. Alternatively, in a first round of play "GLORIA" could correctly predict the next winning number and then "MONICA" could correctly predict the next winning number in the second and third round of play but no one correctly predicts in the fourth round of play. Then "GLORIA" would have paid out at 5 to 1 after the first round of play and "MONICA" pays out 5 to 1 and 500 to 1 after the third round of play because her correct sequence lasted for two consecutive correct guesses and all icons are set back to zero after the fourth round of play.

For example purposes the payouts have been presented as 5 to 1, 500 to 1 and 5000 to 1; however, as known to one of skill in the art the payout at each correctly predicted winning number could also come from a progressive jackpot as is known in the gaming industry.

The disclosed side bet system 30 with the side bet option will enhance play at the roulette wheel 12 by providing an exciting additional betting option that pays out at much higher amounts compared to all other roulette options. It does not slow the play of the game as it occurs simultaneously with a round of play. The rules are simple and quickly grasped by a roulette player and do not include the use of a random number generator. The side bet option does not require any increase in the size of the table top 14 of a standard roulette wheel system 10.

The foregoing disclosure has been described in accordance with the relevant legal standards, thus the description is exemplary rather than limiting in nature. Variations and modifications to the disclosed embodiment may become apparent to those skilled in the art and do come within the scope of the disclosure. Accordingly, the scope of legal protection afforded this disclosure can only be determined by studying the following claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

I claim:

1. A side bet system for a roulette game comprising:

a roulette wheel having a track with a plurality of pockets, each of said pockets associated with a unique number, wherein said unique number represents a possible outcome of a round of play, and a ball;

a camera, said camera detecting both movement and location of said ball on said track, said camera sending a signal to a computer processing unit when said camera detects said ball moving on said track during said round of play, said camera further detecting when said ball lands in one of said plurality of pockets and stops moving on said track, said unique number associated with said pocket having said ball therein being an actual outcome of said round of play, and said camera communicating said actual outcome to said computer processing unit;

said computer processing unit including a database stack, said database stack having a plurality of sequentially numbered positions equal to a total number of said possible outcomes, each of said possible outcomes placed by said computer processing unit in one of said plurality of sequentially numbered positions based on a historical frequency of said possible outcome as said actual outcome over a plurality of rounds of play of said roulette game with a historically most frequent of said actual outcomes in a first of said plurality of sequentially numbered positions in said database stack and a historically least frequent of said actual outcomes in a last of said plurality of sequentially numbered positions of said database stack;

a side bet display connected to said computer processing unit, said side bet display displaying both a plurality of side bet icons and associated with each of said side bet icons a different one of said possible outcomes thereby creating a plurality of displayed possible outcomes on said side bet display, wherein each of said plurality of displayed possible outcomes is selected by said computer processing unit from said database stack;

a plurality of chip racks, each of said chip racks associated with one of said side bet icons, and at least one sensor associated with said plurality of chip racks, said at least one sensor detecting both an identity and a denomination of a wagering chip placed in any of said plurality of chip racks and communicating both to said computer processing unit; and wherein each of said plurality of displayed possible outcomes are selected by said computer processing unit and displayed by said side bet display only after said computer processing unit receives said signal from said camera indicating said ball is moving on said track and wherein after said round of play said computer processing unit rearranges said possible outcomes in said database stack to reflect said historical frequency of said possible outcome as said actual outcome over a plurality of rounds of play.

2. The side bet system for said roulette game as recited in claim 1 wherein said side bet display further displays a set of rules for said side bet system.

3. The side bet system for said roulette game as recited in claim 1 wherein said side bet display further displays said actual outcome of said round of play.

4. The side bet system for said roulette game as recited in claim 1 wherein said side bet display further displays a result of a wager on one or more of said side bet icons.

5. A method of playing a side bet system for a roulette game comprising playing a plurality of rounds of play according to the following steps:

A) providing the side bet system for the roulette game comprising the following elements:

1) a roulette wheel having a track with a plurality of pockets, each of said pockets associated with a unique number, wherein said unique number represents a possible outcome of a round of play, and a ball;

2) a camera, said camera capable of detecting both movement and location of said ball on the track, said camera for sending a signal to a computer processing unit when said camera detects said ball moving on said track during said round of play, said camera further detecting when said ball lands in one of said plurality of pockets and stops moving on said track, said unique number associated with said pocket having said ball therein being an actual outcome of said round of play, and said camera capable of communicating said actual outcome to said computer processing unit;

3) said computer processing unit including a database stack, said database stack having a plurality of sequentially numbered positions equal to a total number of said possible outcomes, each of said possible outcomes placed by said computer processing unit in one of said plurality of sequentially numbered positions based on a historical frequency of said possible outcome as said actual outcome over the plurality of rounds of play of said roulette game with a historically most frequent of said actual outcomes in a first of said plurality of sequentially numbered positions in said database stack and a historically least frequent of said actual outcomes in a last of said plurality of sequentially numbered positions of said database stack;

4) a side bet display connected to said computer processing unit, said side bet display for displaying both a plurality of side bet icons and associated with each of said side bet icons a different one of said possible outcomes thereby creating a plurality of displayed possible outcomes on said side bet display, wherein each of said plurality of displayed possible outcomes is selected by said computer processing unit from said database stack;

5) a plurality of chip racks, each of said chip racks associated with one of said side bet icons, and at least one sensor associated with said plurality of chip racks, said at least one sensor detecting both an identity and a denomination of a wagering chip placed in any of said plurality of chip racks and communicating both to said computer processing unit; and 6) wherein each of said plurality of displayed possible outcomes are selected by said computer processing unit and displayed by said side bet display only after said computer processing unit receives said signal from said camera indicating said ball is moving on said track and wherein after said round of play said computer processing unit rearranges said possible outcomes in said database stack to reflect said historical frequency of said possible outcome as said actual outcome over a plurality of rounds of play;

B) playing one of said plurality of rounds of play according to the following steps:

1) having a dealer spin said roulette wheel and drop said ball onto said track;

2) having said camera detect said ball moving on said track and sending said signal to said computer processing unit;

3) having said computer processing unit select one of said possible outcomes from said database stack for association with each of said side bet icons and sending said possible outcomes to said side bet display;

4) said side bet display displaying each of said possible outcomes selected by said computer processing unit in association with each of said side bet icons;

5) allowing at least one player to place a wager on one or more of said side bet icons and said at least one sensor associated with said plurality of chip racks communicating said wager on one or more of said side bet icons to said computer processing unit;

6) having said camera detect said actual outcome of said round of play;

7) having said computer processing unit compare said actual outcome of said round of play to each of said possible outcomes displayed by said side bet display to determine if said actual outcome of said round of play matches one of said possible outcomes displayed by said side bet display;

a) if no match is determined then play reverts to step B) 1) and any of said wagers is collected;

b) if a match is found then said possible outcome displayed by said side bet display matching said actual outcome of said round of play is designated as a first consecutive winning number, any of said wagers placed on said side bet icon associated with said first consecutive winning number are paid off at a first pre-determined ratio and said wagers are allowed to remain on said side bet icon associated with said first consecutive winning number designated in this step for an immediately subsequent one of said rounds of play, all of said wagers placed on any other of said side bet icons are collected and play proceeds to step B) 8);

8) playing another of said plurality of rounds of play according to steps B) 1) to B) 6) with the exception that in step B) 5) said wager is not permitted to be added onto said side bet icon associated with said first consecutive winning number designated in the immediately preceding one of said plurality of rounds of play;

9) having said computer processing unit compare said actual outcome from step B) 8) to each of said possible outcomes displayed by said side bet display to determine if said actual outcome matches one of said possible outcomes displayed by said side bet display;

a) if no match is determined then play reverts to step B) 1) and any of said wagers is collected;

b) if one of said possible outcomes displayed by said side bet display matches said actual outcome from step B) 8) then said computer processing unit determines if the matching one of said possible outcomes displayed by said side bet display is associated with the same one of said side bet icons that was previously associated with said first consecutive winning number designated in the immediately preceding one of said plurality of rounds of play;

1) if the matching one of said possible outcomes displayed by said side bet display is associated with the same one of said side bet icons that was previously associated with said first consecutive winning number designated in the immediately preceding one of said plurality of rounds of play, then said actual outcome of step B) 8) is designated as a second consecutive winning number, any of said wagers placed on said side bet icon associated with said second consecutive winning number are paid off at a second pre-determined ratio and all other of said wagers are collected, said second pre-determined ratio being greater than said first pre-determined ratio, and said wagers are allowed to remain on said side bet icon associated with said second consecutive winning number for an immediately subsequent one of said plurality of rounds of play and play proceeds to step B) 10);

2) if the matching one of said possible outcomes displayed by said side bet display is not associated with the same one of said side bet icons that was previously associated with said first consecutive winning number designated in the immediately preceding one of said plurality of rounds of play, then said actual outcome of step B) 8) is designated as said first consecutive winning number and play reverts to step B) 7) b);

10) playing another of said plurality of rounds of play according to steps B) 1) to B) 6) with the exception that in step B) 5) said wager is not permitted to be added onto said side bet icon associated with both said first consecutive winning number and said second consecutive winning number in the two immediately preceding of said plurality of rounds of play;

11) having said computer processing unit compare said actual outcome from step B) 10) to each of said possible outcomes displayed by said side bet display to determine if said actual outcome matches one of said possible outcomes displayed by said side bet display;

a) if none of said possible outcomes matches said actual outcome then play reverts to step B) 1) and any of said wagers is collected;

b) if one of said possible outcomes displayed by said side bet icon matches said actual outcome from step B) 10) then said computer processing unit determines if the matching one of said possible outcomes is associated with the same one of said side bet icons that was previously associated with said second consecutive winning number designated in the immediately preceding one of said plurality of rounds of play;

1) if the matching one of said possible outcomes displayed by said side bet display is associated with the same one of said side bet icons that was previously associated with said second consecutive winning number designated in the immediately preceding one of said plurality of rounds of play, then said actual outcome of step B) 10) is designated as a third consecutive winning number and play proceeds to step B) 12);

2) if the matching one of said possible outcomes displayed by said side bet display is not associated with the same one of said side bet icons that was previously associated with said second consecutive winning number in the immediately preceding one of said plurality of rounds of play, then said actual outcome of step B) 10) is designated as said first consecutive winning number and play reverts to step B) 7) b);

12) any of said wagers placed on said side bet icon associated with said first consecutive winning number, said second consecutive winning number and said third consecutive winning number in the three immediately preceding ones of said plurality of rounds of play are paid off at a third pre-determined ratio, said third pre-determined ratio being greater than said second pre-determined ratio, and said wagers are removed from said side bet icon associated with said first consecutive winning number, said second consecutive winning number and said third consecutive winning number and returned to said player who placed said wagers and play reverts to step B) 1).

* * * * *